US012035747B2

(12) United States Patent
Lavanant et al.

(10) Patent No.: US 12,035,747 B2
(45) Date of Patent: Jul. 16, 2024

(54) AEROSOL-GENERATING ARTICLE COMPRISING A LIQUID DELIVERY ELEMENT

(71) Applicant: PHILIP MORRIS PRODUCTS S.A., Neuchatel (CH)

(72) Inventors: Laurent Lavanant, Evian-les-Bains (FR); Yves Jordil, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 479 days.

(21) Appl. No.: 16/066,198

(22) PCT Filed: Dec. 21, 2016

(86) PCT No.: PCT/EP2016/082244
§ 371 (c)(1),
(2) Date: Jun. 26, 2018

(87) PCT Pub. No.: WO2017/114727
PCT Pub. Date: Jul. 6, 2017

(65) Prior Publication Data

US 2019/0014815 A1 Jan. 17, 2019

(30) Foreign Application Priority Data

Dec. 30, 2015 (EP) ..... 15203131

(51) Int. Cl.
*A24D 3/06* (2006.01)
*A24D 3/04* (2006.01)
*A24D 3/02* (2006.01)

(52) U.S. Cl.
CPC ..... *A24D 3/061* (2013.01); *A24D 3/048* (2013.01); *A24D 3/0216* (2013.01)

(58) Field of Classification Search
CPC .... A24D 1/002; A24D 3/0212; A24D 3/0216; A24D 3/022; A24D 3/04; A24D 3/061
See application file for complete search history.

(56) References Cited

U.S. PATENT DOCUMENTS 3,596,665 A 8/1971 Lindgard
3,762,422 A * 10/1973 Dock ..... A24D 3/061 131/337

(Continued)

FOREIGN PATENT DOCUMENTS

CN 101232825 7/2008
CN 102834027 12/2012

(Continued)

OTHER PUBLICATIONS

Dienamics, "Lets talk about polyethylene terephthalate," Published Sep. 4, 2017, Accessed Dec. 3, 2021, <https://dienamics.com.au/blog/lets-talk-about-polyethylene-terephthalate/>. (Year: 2017).*

(Continued)

*Primary Examiner* — Philip Y Louie
*Assistant Examiner* — Sonny V Nguyen
(74) *Attorney, Agent, or Firm* — Mueting Raasch Group

(57) ABSTRACT

An aerosol-generating article (10) comprises an aerosol-generating substrate (12) and a mouthpiece (14) secured to a downstream end of the aerosol-generating substrate (12), the mouthpiece (14) comprising at least one segment of filter material (18, 20) and a liquid delivery element (22). The liquid delivery element (22) comprises: an upstream end and a downstream end; a deformable outer container (28) having at least one flexible wall (32) defining a cavity (40), the cavity (40) containing a liquid (42); and a frangible tubular element (30) mounted within the cavity (40) of the deformable outer container (28) and defining a longitudinal channel (46) extending through the deformable outer container (28)

(Continued)

between the upstream end and the downstream end of the liquid delivery element (22).

20 Claims, 2 Drawing Sheets

(56) References Cited

U.S. PATENT DOCUMENTS

| | | | | |
|---|---|---|---|---|
| 3,884,246 | A | 5/1975 | Walker | |
| 3,991,773 | A * | 11/1976 | Walker | A24D 3/048 131/337 |
| 4,865,056 | A * | 9/1989 | Tamaoki | B65D 17/06 131/337 |
| 5,730,160 | A * | 3/1998 | Schneider | A24D 1/00 131/364 |
| 7,578,298 | B2 | 8/2009 | Fournier | |
| 8,671,951 | B2 | 3/2014 | Ercelebi | |
| 2004/0261807 | A1 | 12/2004 | Dube | |
| 2006/0174901 | A1* | 8/2006 | Karles | A24D 3/163 131/337 |
| 2009/0007925 | A1* | 1/2009 | Rasouli | A24D 3/061 131/275 |
| 2013/0047999 | A1* | 2/2013 | Rushforth | A24D 3/068 131/331 |
| 2014/0290678 | A1* | 10/2014 | Besso | A24D 3/04 131/337 |
| 2014/0311508 | A1* | 10/2014 | Besso | A24D 1/02 131/337 |
| 2016/0219930 | A1* | 8/2016 | Reed | A24D 3/10 |
| 2019/0373946 | A1* | 12/2019 | Jordil | A24D 3/14 |

FOREIGN PATENT DOCUMENTS

| | | | | |
|---|---|---|---|---|
| CN | 103271438 | | 9/2013 | |
| EP | 0276021 | | 7/1988 | |
| JP | 1989-080273 | | 3/1989 | |
| JP | S6480273 | | 3/1989 | |
| WO | WO 2007/060543 | | 5/2007 | |
| WO | WO 2012/156698 | | 11/2012 | |
| WO | WO 2014/068295 | | 5/2014 | |
| WO | WO-2014128973 | A1 * | 8/2014 | A24D 3/04 |
| WO | WO 2014/184239 | | 11/2014 | |

OTHER PUBLICATIONS

Sagae, Hiromi, "Machine translation of WO 2014/128973," Translated Jun. 26, 2022, Espacenet.com (Year: 2022).*

Creative Mechanisms, "Everything You Need to Know About PVC Plastic," Published Jul. 26, 2016, Accessed Jun. 26, 2022, <https://www.creativemechanisms.com/blog/everything-you-need-to-know-about-pvc-plastic>. (Year: 2016).*

PCT Search Report and Written Opinion for PCT/EP2016/082244 dated Feb. 7, 2017 (7 pages).

Extended European Search Report for Application No. 15203131.6 dated Jun. 9, 2016 (6 pages).

Office Action issued in China for Application No. 201680071329.4 dated Jun. 2, 2020 (18 pages). English translation included.

Office Action issued in Japan for Application No. 2018-530776 dated Nov. 24, 2020 (11 pages). English translation included.

Office Action issued in Japan for Application No. 2018-530776 dated Mar. 16, 2022 (5 pages). English translation included.

* cited by examiner

AEROSOL-GENERATING ARTICLE COMPRISING A LIQUID DELIVERY ELEMENT

This application is a U.S. National Stage Application of International Application No. PCT/EP2016/082244, filed Dec. 21, 2016, which was published in English on Jul. 6, 2017, as International Publication No. WO 2017/114727 A1. International Application No. PCT/EP2016/082244 claims priority to European Application No. 15203131.6 filed Dec. 30, 2015.

The present invention relates to an aerosol-generating article comprising a liquid delivery element. The invention finds particular application as an elongate smoking article, such as a cigarette.

Smoking articles, such as cigarettes, typically comprise an aerosol-generating substrate, such as a tobacco rod, attached to a mouthpiece. Conventional mouthpieces comprise one or more segments of a filtration material such as cellulose acetate tow. In some cases, it may be desirable to provide a liquid within the filtration material to alter a taste sensation experienced by a consumer during smoking of the smoking article. For example, it may be desirable to provide water or a liquid flavourant within the filtration material. However, liquids deposited directly onto the filtration material during manufacture of the smoking article may escape during storage and cause staining of other components of the smoking article, or the packaging. Volatile liquids deposited directly onto the filtration material during manufacture may escape the smoking article and the package entirely.

Some attempts to reduce or eliminate the leakage or escape of liquids from the mouthpieces of smoking articles use a container positioned within the mouthpiece and in which the liquid is contained until a consumer releases the liquid from the container, either immediately before or during smoking of the smoking article. For example, EP-0276021-A2 describes a cigarette comprising a breakable plastic capsule situated in the vicinity of a filter member, the breakable plastic capsule containing a fluid material. However, the breakable plastic capsule described in EP-0276021-A2 is combined with additional components, such as a corrugated sheet wrapped around the breakable plastic capsule, to form smoke passages around the breakable plastic capsule. The cigarettes described in EP-0276021-A2 are therefore complex to manufacture, requiring the registration and assembly of multiple components to form the filter section of each cigarette.

US-3991773-A discloses a filter element comprising a liquid containing frangible module provided within a chamber defined by a resilient liquid-impervious tubular casing. A porous plug of filter material is provided at either end of the tubular casing and the filter is designed such that the liquid from the module is released into the porous plugs when the tubular casing is compressed to rupture the module.

It would be desirable to provide an aerosol-generating article that overcomes the disadvantages associated with known smoking articles. In particular, it would be desirable to provide an aerosol-generating article that includes novel means for delivering a liquid to a segment of filter material whilst enabling a desirable resistance to draw to be maintained through the article. It would be particularly desirable to provide such a means for delivering a liquid which can be readily incorporated into existing filter constructions such that the filters can be manufactured with minimal modification to existing high speed manufacturing machines and processes.

According to the invention there is provided an aerosol-generating article comprising an aerosol-generating substrate and a mouthpiece secured to a downstream end of the aerosol-generating substrate, the mouthpiece comprising at least one segment of filter material and a liquid delivery element. The liquid delivery element comprises an upstream end and a downstream end; a deformable outer container having at least one flexible wall; and a frangible tubular element mounted within the deformable outer container and defining a longitudinal channel extending through the deformable outer container between the upstream end and the downstream end of the liquid delivery element. A cavity is defined between the at least one flexible wall of the deformable outer container and the frangible tubular element, the cavity containing a liquid which surrounds the frangible tubular element. According to the invention, the liquid delivery element is configured to deliver the liquid from the cavity to the at least one segment of filter material when at least one wall of the frangible tubular element is broken. The frangible tubular element is breakable upon application of a force to the liquid delivery element to deform the deformable outer container.

According to the invention there is further provided a liquid delivery element comprising: a first end and a second end; a deformable outer container having at least one flexible wall; and a frangible tubular element mounted within the deformable outer container and defining a longitudinal channel extending through the deformable outer container between the first end and the second end of the liquid delivery element. A cavity is defined between the at least one flexible wall of the deformable outer container and the frangible tubular element, the cavity containing a liquid which surrounds the frangible tubular element. The liquid delivery element is configured to release the liquid from the cavity when at least one wall of the frangible tubular element is broken. The frangible tubular element is breakable upon application of a force to the liquid delivery element to deform the deformable outer container.

As used herein, the term "liquid delivery element" refers to a discrete mouthpiece element for the storage and delivery of a liquid within the mouthpiece. The liquid delivery element of the present invention comprises a frangible tubular element mounted within a deformable outer container and is configured to be activated by the consumer. The present invention therefore provides a novel means for the delivery of a liquid within a filter that is distinct from the known capsules and other delivery devices of the prior art.

As used herein, the terms "upstream" and "downstream" describe the relative positions of elements, or portions of elements, of the aerosol-generating article in relation to the direction in which a consumer draws on the aerosol-generating article during use thereof. Aerosol-generating articles as described herein comprise a downstream end, corresponding to the mouth end, and an opposed upstream end. In use, a consumer draws on the downstream end of the aerosol-generating article. The downstream end is downstream of the upstream end, which may also be described as the distal end.

As used herein, the term "aerosol-generating substrate" is used to describe a substrate capable of releasing, upon heating, volatile compounds, which can form an aerosol. The aerosol generated from aerosol-generating substrates may be visible or invisible and may include vapours (for example, fine particles of substances, which are in a gaseous state, that are ordinarily liquid or solid at room temperature) as well as gases and liquid droplets of condensed vapours.

By providing a liquid within a cavity of a liquid delivery element, aerosol-generating articles according to the present invention can reduce or prevent escape of the liquid from the aerosol-generating article during storage.

Furthermore, providing the liquid within a cavity of a liquid delivery element also provides the consumer with a choice over when to deliver the liquid from the liquid delivery element to the at least one segment of filter material. For example, a consumer may choose to deliver the liquid to the at least one segment of filter material immediately before smoking the aerosol-generating article, or during smoking of the aerosol-generating article. Alternatively, a consumer may choose to smoke the aerosol-generating article without delivering the liquid from the liquid delivery element to the at least one segment of filter material.

By providing a liquid delivery element comprising a longitudinal channel extending between the upstream and downstream ends of the liquid delivery element, aerosol-generating articles according to the present invention can incorporate the liquid delivery element into the mouthpiece and maintain a resistance to draw that is similar to, or lower than, the resistance to draw of a corresponding aerosol-generating article that does not include a liquid delivery element, such as a conventional filter cigarette.

Furthermore, by forming the longitudinal channel as part of the liquid delivery element that extends between the upstream and downstream ends, aerosol-generating articles according to the present invention can be manufactured using existing high speed manufacturing machines and processes with minimal modification. In particular, the liquid delivery element can be combined with other mouthpiece segments, such as the at least one segment of filter material, using a conventional combining process.

As defined above, the aerosol-generating article according to the present invention incorporates a novel liquid delivery element having a frangible, or breakable, tubular element mounted within a deformable outer container, with a cavity defined between the core element and the outer container. The resulting cavity is annular and extends around the frangible tubular element. Prior to the activation of the liquid delivery element, the liquid remains held within the cavity and the longitudinal channel defined by the frangible tubular element extends all of the way through the liquid delivery element to provide an airflow pathway through which aerosol can be drawn during smoking of the aerosol-generating article.

As used herein, the term "activate" refers to an action that causes the liquid delivery element to deliver the liquid from the cavity to the at least one segment of filter material. In the context of the present invention, activation is brought about by application of a compressive force to the liquid delivery element to deform the deformable outer container. To activate the liquid delivery element, the deformable outer container must be squeezed by the consumer to a sufficient extent that the compressive force causes the frangible tubular element to break. Upon breakage of the frangible tubular element, the liquid is released from the cavity through one or more liquid pathways into the at least one segment of filter material.

The consumer therefore has control over the delivery of the liquid to the at least one segment of filter material. The liquid delivery element may be configured such that the liquid is substantially all released from the cavity upon initial breakage of the frangible tubular element. Alternatively, the liquid delivery element may be configured such that the consumer may choose to deliver only some of the liquid from the cavity, with the remainder of the liquid remaining in the cavity for one or more subsequent deliveries.

Advantageously, the consumer is able to feel when the frangible tubular element has broken to activate the liquid delivery element and can therefore apply only the required degree of compression, thereby avoiding damage to the mouthpiece as a result of excessive compressive force. Alternatively or in addition, the breakage of the frangible tubular element may produce an audible sound such that the consumer can hear when the liquid delivery element has been activated.

Preferably the compressive force required to activate the liquid delivery element through breakage of the frangible tubular element is between about 10 Newtons and about 50 Newtons, preferably between about 20 Newtons to about 40 Newtons, and more preferably between about 25 Newtons and about 35 Newtons. The compressive force may be determined using a universal tensile/compression testing machine equipped with 100 Newton tension load cell, such as Instron or equivalent, operating at about 30 millimetres per minute and at 22 degrees Celsius under 60 percent relative humidity. An example of a manual test machine is the Alluris Type FMI—220C2—Digital Force Gauge 0-200N, available from Alluris GmbH & Co.

The frangible tubular element preferably cracks, fractures or snaps under an applied force rather than shattering, such that the frangible tubular element does not break apart but retains its structural integrity as far as possible after activation.

The frangible tubular element may advantageously be configured such that the directionality of the liquid release from the cavity is controlled. For example, it may be desirable to provide delivery of the liquid in one axial direction towards a filter segment on one side of the liquid delivery element or to provide delivery of the liquid in both axial directions towards filter segments on both sides of the liquid delivery element.

As described above, the liquid delivery element is configured such that upon breakage of at least one wall of the frangible tubular element, one or more liquid pathways are opened up through the liquid delivery element to allow the liquid to flow out of the liquid delivery element and into the adjacent segment or segments of filter material. Preferably, the liquid delivery element is configured to deliver the liquid through the longitudinal channel of the frangible tubular element upon breakage of the frangible tubular element. In such embodiments, the breakage of the frangible tubular element enables the liquid from the cavity to enter the longitudinal channel, which provides a liquid pathway for the liquid to be released from the cavity into the at least one segment of filter material. The longitudinal channel advantageously enables the liquid to be delivered in both an upstream and a downstream direction from the liquid delivery element.

Preferably, the maximum diameter of the longitudinal channel of the frangible tubular element is between about 1 millimetre and about 3 millimetres, more preferably between about 1 millimetre and about 2 millimetres, more preferably between about 1.1 millimetres and about 1.5 millimetres.

Additionally or alternatively, the transverse cross-sectional area of the longitudinal channel is preferably between about 1 square millimetre and about 7 square millimetres, more preferably between about 1 square millimetre and about 3 square millimetres, more preferably between about 1 square millimetre and about 1.8 square millimetres.

Additionally or alternatively, the length of the longitudinal channel is preferably between about 8 millimetres and about 12 millimetres, preferably about 10 millimetres.

The longitudinal channel may have any suitable cross-sectional shape. In some embodiments, the longitudinal channel has a substantially square or rectangular cross-sectional shape. Preferably, the longitudinal channel has a substantially circular cross-sectional shape.

The dimensions of the longitudinal channel may be configured in order to provide the desired resistance to draw of the aerosol-generating article.

The longitudinal channel is preferably configured so that the aerosol-generating article has a resistance to draw of between about 50 millimetres of water gauge and about 130 millimetres of water gauge, more preferably between about 70 millimetres of water gauge and 110 millimetres of water gauge, before the liquid is delivered from the liquid delivery element into the at least one segment of filter material. The resistance to draw of aerosol-generating articles according to the present invention may be substantially the same as, or similar to, the resistance to draw of otherwise identical aerosol-generating articles in which the liquid delivery element is replaced with a segment of filter material.

As used herein, the term "resistance to draw" refers to the pressure required to force air through the full length of the object under test at the rate of 17.5 millilitres per second at 22 degrees Celsius and 101 kilopascals (760 Torr). Resistance to draw is expressed in units of millimetres water gauge (mmWG) and is measured in accordance with ISO 6565:2011.

The resistance to draw of the aerosol-generating article after the liquid is delivered from the liquid delivery element into the at least one segment of filter material may be similar to the resistance to draw of the aerosol-generating article before the liquid is delivered from the liquid delivery element into the at least one segment of filter material. Preferably, the aerosol-generating article is configured to have a resistance to draw of between about 10 millimetres of water gauge and about 30 millimetres of water gauge higher than the resistance to draw of the aerosol-generating article before the liquid is delivered from the liquid delivery element to the at least one segment of filter material. Additionally, or alternatively, the aerosol-generating article may be configured to have a resistance to draw of between about 60 millimetres of water gauge and about 160 millimetres of water gauge, preferably between about 80 millimetres of water gauge and about 140 millimetres of water gauge, after the liquid is delivered from the liquid delivery element into the at least one segment of filter material.

Preferably, the resistance to draw of the aerosol-generating article before the liquid is delivered from the liquid delivery element into the at least one segment of filter material is no more than 30 millimetres of water gauge, more preferably no more than 10 millimetres, greater than the resistance to draw of an aerosol-generating article having a corresponding construction but without the liquid delivery element. In the latter case, the liquid delivery element is replaced by a standard plug of filtration material to retain corresponding dimensions to the aerosol-generating article of the present invention. In certain preferred embodiments, the resistance to draw of the aerosol-generating article before the liquid is delivered from the liquid delivery element into the at least one segment of filter material is substantially equal to the resistance to draw of an aerosol-generating article having a corresponding construction but without the liquid delivery element.

In certain embodiments, the dimensions of the longitudinal channel may also be adapted in order to control the rate of delivery of the liquid. For example, the ratio of the volume of the longitudinal channel to the volume of liquid in the cavity may be controlled in order to control the delivery of the liquid from the cavity.

The skilled person will also appreciate that the dimensions of the frangible tubular element may be adapted in order to control the level of deformation of the outer container that is required in order to break the frangible tubular element during use. Typically, the narrower the outer diameter of the frangible tubular element, the greater the deformation that will be required in order for the consumer to apply sufficient pressure to break the frangible tubular element and activate the liquid delivery element. Increased levels of deformation will typically cause greater levels of pressure to be exerted on the walls and seals of the deformable outer container. It may therefore be desirable to maximise the external diameter of the frangible tubular element as much as possible in order to minimise such pressures on the deformable outer container, whilst retaining sufficient space within the cavity to provide the liquid required for release into the filter material.

As set out above, the frangible tubular element defines the longitudinal channel. The longitudinal channel is therefore provided by the lumen of the frangible tubular element.

The outer diameter of the frangible tubular element and therefore the ratio of the outer diameter of the frangible tubular element to the outer diameter of the liquid delivery element may be adapted to control the volume of the cavity containing the liquid. Preferably, the maximum outer diameter of the frangible tubular element is between about 20 and about 50 percent of the maximum outer diameter of the liquid delivery element, more preferably between about 20 and about 30 percent, most preferably about 25 percent.

The frangible tubular element preferably has a wall thickness of between about 100 microns and about 500 microns. The wall thickness may be adapted to provide the desired level of brittleness of the frangible tubular element.

The frangible tubular element is preferably formed of a polymeric material. Suitable polymer materials include polystyrene, polyethylene terephthalate, poly(methyl methacrylate) and combinations thereof. The polymer may be injection moulded or extruded to form the frangible tubular element.

As described above, the frangible tubular element of the liquid delivery elements of the present invention is mounted within the deformable outer container such that the liquid in the cavity surrounds the frangible tubular element. The deformable outer container comprises at least one flexible wall to achieve sufficient deformation of the deformable outer container that the compressive force breaks the frangible tubular element. As would be appreciated by the skilled person, the degree of deformation required may depend upon factors such as the size of the frangible tubular element relative to the deformable outer container and the volume of liquid within the cavity.

In preferred embodiments, the deformable outer container comprises a tube of a flexible sheet material forming the flexible wall, with an upstream and downstream end wall to seal the tube ends to define the cavity. Preferably, each of the upstream and downstream ends walls comprises an aperture, wherein the longitudinal channel of the frangible tubular element extends between the apertures to provide a fluid pathway through the liquid delivery element.

Preferably, the frangible tubular element is mounted in at least one of the apertures in the upstream and downstream end walls. For example, in certain preferred embodiments in which the frangible tubular element is a frangible tubular element, the frangible tubular element is mounted in one or both of the apertures in the upstream and downstream end walls.

Preferably, the frangible tubular element is integral with at least one of the upstream and downstream end walls. This may aid incorporation of the frangible tubular element into the deformable outer container. Where the frangible tubular element is integral with an end wall, the aperture of that end wall is defined by the opening at the corresponding distal end of the longitudinal channel in the frangible tubular element. In certain preferred embodiments, the frangible tubular element is integral with one of the end walls and is mounted within the aperture of the opposite end wall.

The end walls of the deformable outer container may be deformable or non-deformable. Preferably, at least one end wall is non-deformable to facilitate assembly of the liquid delivery element.

The end walls are preferably adapted to fit within the tube forming the flexible wall in order to retain the end walls in position whilst providing the necessary sealing of the cavity. The end walls may be sealed within the tube through use of a suitable adhesive, a sealing O-ring, or both.

Preferably, the at least one flexible wall of the deformable outer container is formed from a flexible sheet material, preferably a polymeric sheet material. Particularly preferably, the flexible sheet material is substantially transparent.

The term "substantially transparent" is used to describe a material which allows at least a significant proportion of incident light to pass through it, so that it is possible to see through the material. In the present invention, a substantially transparent flexible wall may allow sufficient light to pass through it so that the liquid within the cavity is visible before activation of the liquid delivery element. Where the liquid within the cavity is also transparent, a substantially transparent flexible wall may also allow the smoke or one or more other aerosols generated by the aerosol-generating substrate and passing through the longitudinal channel during smoking of the aerosol-generating article to be visible.

The substantially transparent flexible wall may be completely transparent. Alternatively, the substantially transparent flexible wall may have a lower level of transparency while still transmitting sufficient light that at least one of the smoke or one or more other aerosols and the liquid are visible through the substantially transparent liquid delivery element.

In those embodiments in which the at least one flexible wall of the deformable outer container is substantially transparent, preferably any materials overlying the deformable outer container are formed from a substantially transparent material, or comprise one or more apertures so that a portion of the liquid delivery element is visible through the one or more apertures.

Optionally, the flexible sheet material forming the at least one flexible wall of the deformable outer container may be coloured or tinted.

Suitable polymeric sheet materials for forming the at least one flexible wall of the deformable outer container include polypropylene isotactic, polyethylene terephthalate or a combination thereof. The flexible sheet material may be formed of a laminate material including at least one waterproof barrier layer such as low density polyethylene, high density polyethylene, ethylene vinyl alcohol, or a combination thereof.

The flexible wall of the deformable outer container preferably has a wall thickness of between about 100 microns and about 300 microns, preferably between about 200 microns and about 300 microns, more preferably about 250 microns.

As described above, a cavity or reservoir is defined between the at least one flexible wall of the deformable outer container and the frangible tubular element, for the liquid contained in the liquid delivery element. Preferably, the volume of liquid contained within the cavity is less than about 80 percent of the total internal volume of the cavity, more preferably less than about 70 percent. This means that the cavity is partially filled with air, which allows for sufficient deformation of the deformable outer container to break the frangible tubular element within the cavity. Furthermore, where the at least one flexible wall is formed of a transparent material, the partial filling of the cavity enables the movement of the liquid within the cavity to be visible to the consumer, such that they can visually identify the presence of the liquid within the liquid delivery element. It may further be desirable to control the amount of liquid within the cavity such that the liquid does not cause the filtration material or filter wrappers to become stained or soggy.

In any of the embodiments described above, the liquid within the cavity of the liquid delivery element may comprise water. The liquid may consist essentially of water.

Alternatively, the liquid may comprise one or more components in addition to water, or as an alternative to water. In those embodiments in which the liquid comprises one or more components in addition to water, each of the additional components may be dissolved in the water or suspended within the water.

In some embodiments the liquid may comprise at least one flavourant, preferably a hydrophilic flavourant. Suitable flavourants include acetoin, sucrose, sorbitol, ethyl lactate, citric acid, chicory extract, alpha ionone, lactic acid, pyruvic acid, vanilla oleoresin, butyl alcohol, butyric acid, benzyl alcohol, ethyl acetate, fenugreek extract, isobutyl alcohol, isobutyric acid, cyclotene, coffee dione, frambinone, 2-3 dimethyl pyrazine, ethyl butyrate, ethyl maltol, ethyl propionate, vanillin, furaneol, isobutyraldehyde, isovaleric acid, maltol, benzaldehyde, dimethyl sulphide, 2 methyl butyric acid, isovaleraldehyde, phenethyl alcohol, phenylacetic acid, heliotropine, valeric acid, valeraldehyde, and combinations thereof.

Additionally, or alternatively, the liquid may comprise at least one humectant. Suitable humectants include glycerol, malitol, xylitol, sorbitol, polyethylene glycol, triethylene glycol, butylene glycol, glycerin, polydextrose, and combinations thereof.

In any of the embodiments described above, the liquid may be substantially colourless. Alternatively, the liquid may be coloured. Coloured liquids may be preferable in those embodiments in which the flexible wall of the deformable outer container is formed from a substantially transparent material so that the coloured liquid is visible.

The liquid delivery element comprising the deformable outer container and the frangible tubular element may have any suitable cross-sectional shape. Preferably, the liquid delivery element is substantially cylindrical and particularly preferably, the liquid delivery element is substantially cylindrical with a substantially circular cross-sectional shape. In preferred embodiments, the liquid delivery element has an outer diameter which substantially corresponds to the outer diameter of the at least one segment of filter material. This facilitates the combination and wrapping of the liquid delivery element with the other filter segments and enables manufacture of the mouthpiece and aerosol-generating article using existing high speed combining machines and processes.

Preferably, the liquid delivery element is substantially symmetrical in a longitudinal direction such that it is immaterial which end of the liquid delivery element is provided as the downstream end within the mouthpiece. This facilitates the incorporation of the liquid delivery element into a mouthpiece since it is not necessary to provide any registration of the liquid delivery element prior to inserting it into the mouthpiece.

The length of the liquid delivery element is preferably between about 8 millimetres and about 12 millimetres, preferably about 10 millimetres.

The liquid delivery element of the present invention may be assembled in a number of different ways depending upon the construction of the deformable outer container and the frangible tubular element. For example, in one assembly process, the deformable outer container is partially formed from a flexible outer tube and a first end wall inserted at one end of the flexible outer tube. The partially formed deformable outer container is then filled with the liquid. The frangible tubular element is then inserted into the filled cavity and through the first end wall and the second end wall is inserted into the flexible outer tube to close the cavity. The frangible tubular element and the second end wall are preferably integral, or connected to each other in a prior assembly step.

In an alternative assembly process, the frangible tubular element may be incorporated into the partially formed deformable outer container as described above, prior to the filling of the deformable outer container with liquid and the sealing of the cavity with the second end wall.

In a further alternative assembly process, the deformable outer container may be fully assembled with the flexible outer tube having both end walls in place. Liquid is then injected through the aperture in one of the end walls to at least partially fill the cavity inside the flexible outer tube. The frangible tubular element is then inserted through the aperture, into the filled cavity and through to the opposite end wall.

In any of assembly processes, the longitudinal channel is preferably flushed with air to remove any liquid trapped therein prior to incorporating the liquid delivery element into a mouthpiece.

In the mouthpiece of aerosol-generating articles according to the invention, the at least one segment of filter material may comprise a downstream filter segment positioned downstream of the liquid delivery element. When the downstream filter segment forms a mouth end of the aerosol-generating article, the downstream filter segment can advantageously provide a desirable mouth feel for the consumer that resembles the mouth feel of a conventional aerosol-generating article.

Additionally, or alternatively, the at least one segment of filter material may comprise an upstream filter segment positioned upstream of the liquid delivery element.

Preferably, the at least one filter segment comprises at least one upstream filter segment and at least one downstream filter segment, wherein the liquid delivery element is positioned between the at least one upstream filter segment and the at least one downstream filter segment.

Preferably, the filtration material within each filter segment is a plug of fibrous filtration material, such as cellulose acetate tow, polylactide or paper. A filter plasticiser may be applied to the fibrous filtration material in a conventional manner, by spraying it onto the separated fibres, preferably before any particulate material is applied to the filtration material.

The mouthpiece of aerosol-generating articles according to the invention may comprise a plug wrap circumscribing the liquid delivery element. The plug wrap may circumscribe only the liquid delivery element. Alternatively, the plug wrap may be a combining plug wrap circumscribing the liquid delivery element and the at least one segment of filter material. Preferably, at least one surface of the plug wrap is coated with an anti-staining coating to prevent leakage of the liquid through the plug wrap after it has been delivered from the cavity to the at least one segment of filter material. Suitable anti-staining coatings include ethyl cellulose and cellulose acetate.

The mouthpiece of aerosol-generating article according to the invention may further comprise a tipping wrapper. In preferred embodiments in which the flexible wall of the deformable outer container of the liquid delivery element is formed from a substantially transparent material, as described above, the aerosol-generating article preferably comprises a substantially transparent plug wrap overlying at least a portion of the liquid delivery element, and a tipping wrapper comprising at least one aperture at least partially overlying the substantially transparent wrapper and the liquid delivery element. This enables the liquid delivery element and the liquid within the cavity to be viewed from the exterior of the mouthpiece.

Aerosol-generating articles according to the present invention may be filter cigarettes or other aerosol-generating articles in which the aerosol-generating substrate comprises a tobacco material that is combusted to form smoke. Therefore, in any of the embodiments described above, the aerosol-generating substrate may comprise a tobacco rod.

Alternatively, aerosol-generating articles according to the present invention may be articles in which a tobacco material is heated to form an aerosol, rather than combusted. In one type of heated aerosol-generating article, a tobacco material is heated by one or more electrical heating elements to produce an aerosol. In another type of heated aerosol-generating article, an aerosol is produced by the transfer of heat from a combustible or chemical heat source to a physically separate tobacco material, which may be located within, around or downstream of the heat source. The present invention further encompasses aerosol-generating articles in which a nicotine-containing aerosol is generated from a tobacco material, tobacco extract, or other nicotine source, without combustion, and in some cases without heating, for example through a chemical reaction.

The invention will now be further described, by way of example only, with reference to the accompanying drawings in which.

Figure 1:
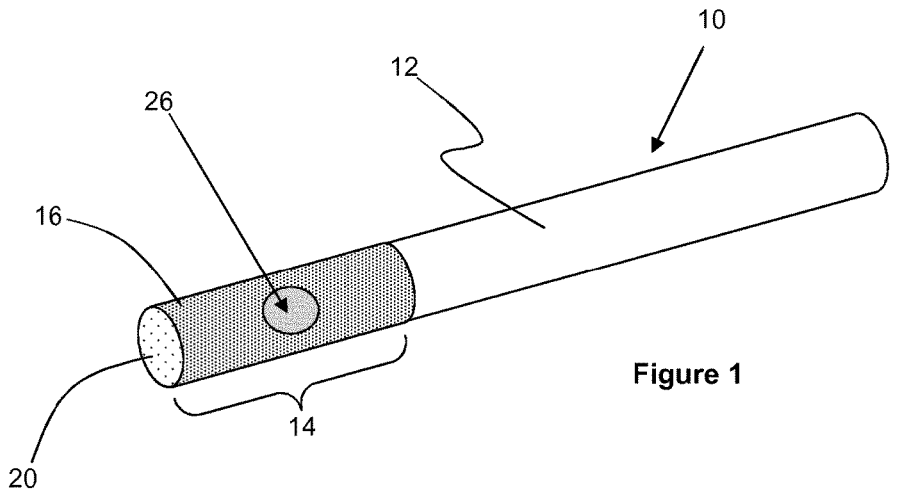
FIG. 1 shows a perspective view of an aerosol-generating article in accordance with the present invention.

FIG. 1 shows an aerosol-generating article 10 according to an embodiment of the present invention. The aerosol-generating article 10 is a filter cigarette comprising an aerosol-generating substrate 12 in the form of a wrapped tobacco rod, and a mouthpiece 14. The mouthpiece 14 is secured to the wrapped tobacco rod by a tipping wrapper 16.

Figure 2:
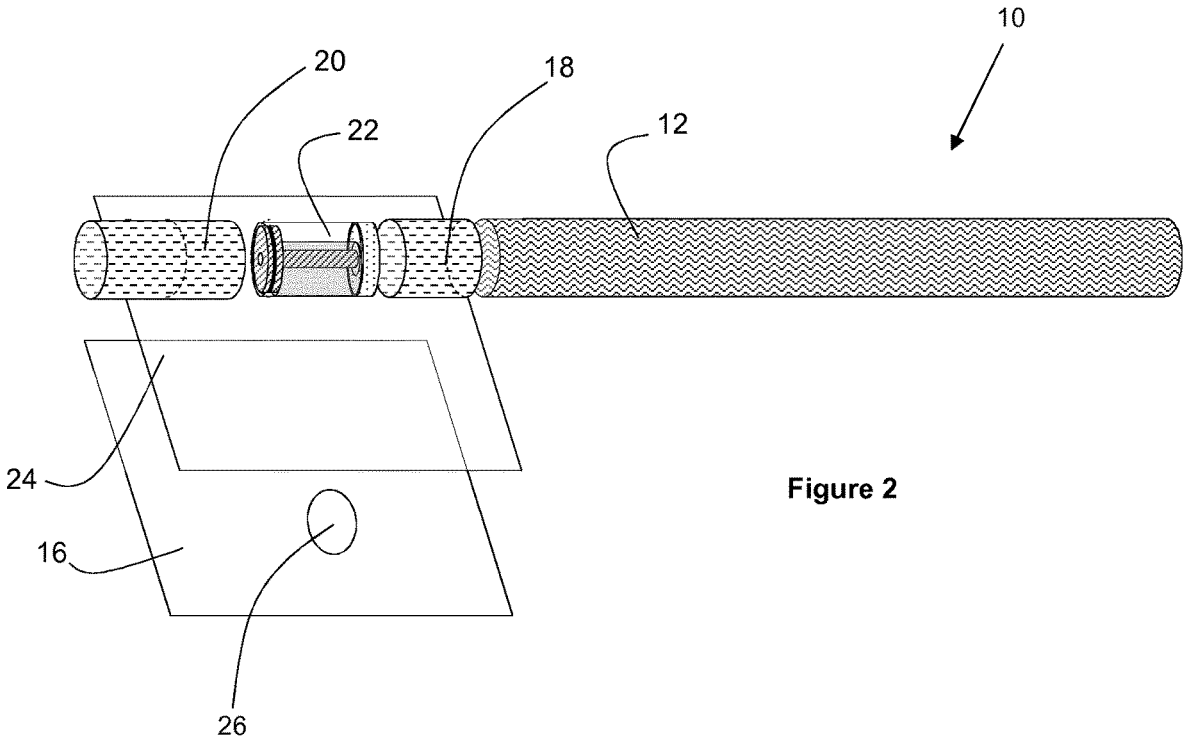
FIG. 2 shows an exploded view of the aerosol-generating article of FIG. 1, with the wrappers unwrapped.

As shown in FIG. 2, the mouthpiece 14 comprises an upstream filter segment 18 at an upstream end of the mouthpiece 14 and a downstream filter segment 20 at a downstream end of the mouthpiece 14. The mouthpiece 14 further comprises a liquid delivery element 22 positioned between the upstream and downstream filter segments 18, 20. A substantially transparent combining plug wrap 24 is wrapped around the upstream 18 and downstream 20 filter segments and the liquid delivery element 22 to combine them and form the mouthpiece 14. The tipping wrapper 16 comprises an aperture 26 overlying the liquid delivery element 22 and the substantially transparent plug wrap 24 so that the consumer can observe the liquid delivery element 22.

Figure 3:
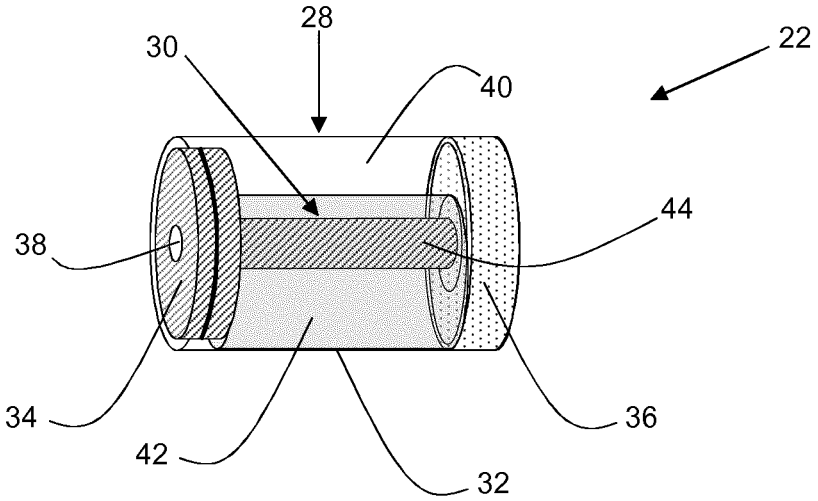
FIG. 3 shows a perspective view of the liquid delivery element of the aerosol-generating article of FIG. 1, prior to activation.
Figure 4:
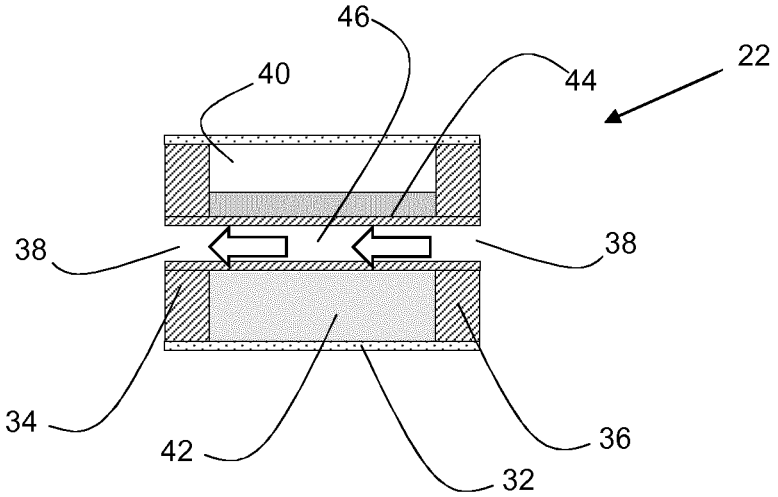
FIG. 4 shows a longitudinal cross-sectional view of the liquid delivery element prior to activation.

As shown in FIGS. 3 and 4, the liquid delivery element 22 comprises a deformable outer container 28 and a frangible tubular element 30. The deformable outer container 28 comprises a flexible outer tube 32 formed of a substantially transparent sheet material, a downstream end wall 34 inserted into the downstream end of the flexible outer tube 32 and an upstream end wall 36 inserted into the upstream end of the flexible outer tube 32. Each of the downstream 34 and upstream 36 end walls comprises a central aperture 38. The deformable outer container 28 comprises a sealed cavity 40 defined within the flexible outer tube 32 and containing a coloured liquid 42 comprising water.

The frangible tubular element 30 is in the form of a frangible tube 44 which is mounted within the cavity 40 of the deformable outer container 28 and extends between the apertures 38 of the downstream 34 and upstream 36 end walls. The frangible tube 44 defines a longitudinal channel 46 extending between the downstream and upstream ends of the liquid delivery element 22. The outer diameter of the frangible tube 44 is approximately 25 percent of the outer diameter of the liquid delivery element 22.

FIG. 4 shows the liquid delivery element 22 prior to activation, with the liquid 42 retained within the cavity 40. The longitudinal channel 46 provides an airflow channel through the liquid delivery element 22, through which the mainstream smoke passes during smoking of the aerosol-generating article 10, as indicated by the arrows. The consumer can observe the coloured liquid 42 within the cavity 40, through the aperture 26 in the tipping wrapper 16.

Figure 5:
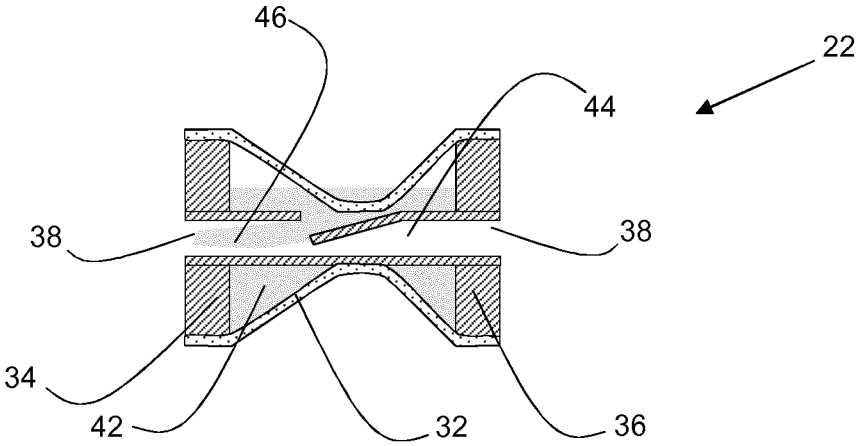
FIG. 5 shows a longitudinal cross-sectional view of the liquid delivery element after activation.

Before or during smoking, the consumer may squeeze the liquid delivery element 22 to activate the liquid delivery element 22 and bring about release of the liquid 42. The compressive force applied to the liquid delivery element 22 causes deformation of the flexible outer tube 32 of the deformable outer container 28 and an increased pressure within the cavity 40. At a certain level of compressive force, the increased pressure within the cavity 40 causes the wall of the frangible tube 44 to crack, thereby activating the liquid delivery element 22. As shown schematically in FIG. 5, the breakage of the frangible tube 44 allows the liquid 42 to pass from the cavity 40 into the longitudinal channel 46. The liquid 42 can then flow along the longitudinal channel 46 into the upstream 18 and downstream 20 filter segments. During this activation of the liquid delivery element 22, the consumer can observe, through the aperture 26 in the tipping wrapper 16, the coloured liquid moving from the cavity 40 into the filter segments 18, 20.

The invention claimed is:

1. An aerosol-generating article comprising an aerosol-generating substrate and a mouthpiece secured to a downstream end of the aerosol-generating substrate, the mouthpiece comprising at least one segment of filter material and a liquid delivery element, the liquid delivery element comprising:

an upstream end and a downstream end;

a deformable outer container having an inner surface and at least one flexible wall; and a frangible tubular element mounted within the deformable outer container having an outer surface facing the inner surface of the deformable outer container and defining a longitudinal channel extending continuously through the deformable outer container from the upstream end to the downstream end of the liquid delivery element, wherein a cavity is defined by the at least one flexible wall of the deformable outer container and the outer surface of the frangible tubular element, the cavity containing a liquid which surrounds the frangible tubular element and contacts the inner surface of the deformable outer container, the at least one flexible wall seals the liquid within the cavity, wherein the liquid delivery element is configured to deliver the liquid from the cavity to the at least one segment of filter material when at least one wall of the frangible tubular element is broken, and wherein the frangible tubular element breaks upon application of a force to the liquid delivery element to deform the deformable outer container.

2. An aerosol-generating article according to claim 1 wherein the liquid delivery element is configured to deliver the liquid through the longitudinal channel of the frangible tubular element upon breakage of at least one wall of the frangible tubular element.

3. An aerosol-generating article according to claim 1 wherein a maximum outer diameter of the frangible tubular element is between 20 percent and 50 percent of a maximum outer diameter of the liquid delivery element.

4. An aerosol-generating article according to claim 1 wherein the deformable outer container comprises a flexible outer tube, an upstream end wall at the upstream end of the flexible outer tube and a downstream end wall at the downstream end of the flexible outer tube, wherein each of the upstream end wall and the downstream end wall comprises an aperture and wherein the longitudinal channel of the frangible tubular element extends continuously between the apertures.

5. An aerosol-generating article according to claim 4 wherein the frangible tubular element is mounted within at least one of the apertures in the upstream end wall and the downstream end wall of the deformable outer container.

6. An aerosol-generating article according to claim 4 wherein the frangible tubular element is integrally formed with at least one of the end walls of the deformable outer container.

7. An aerosol-generating article according to claim 4 wherein at least one of the end walls of the deformable outer container is non-deformable.

8. An aerosol-generating article according to claim 4, wherein the upstream end wall at the upstream end of the flexible outer tube and the downstream end wall at the downstream end define upstream and downstream ends of the cavity containing the liquid which surrounds the frangible tubular element and contacts the inner surface of the deformable outer container.

9. An aerosol-generating article according to claim 4, wherein the frangible tubular element does not extend beyond the upstream end wall of the downstream end wall.

10. An aerosol-generating article according to claim 1 wherein the at least one flexible wall of the deformable outer container is formed from a substantially transparent material.

11. An aerosol-generating article according to claim 1 wherein a volume of liquid in the cavity between the deformable outer container and the frangible tubular element corresponds to less than 80 percent of a total volume of the cavity.

12. An aerosol-generating article according to claim 1 wherein resistance to draw of the aerosol-generating article before the liquid is delivered from the liquid delivery element into the at least one segment of filter material is no more than 30 millimetres of water gauge and greater than resistance to draw of an aerosol-generating article having a corresponding construction but without the liquid delivery element.

13. An aerosol-generating article according to claim 1 wherein the liquid delivery element and the at least one segment of filter material each have a substantially circular cross-sectional shape, and wherein a maximum diameter of the liquid delivery element is substantially the same as a maximum diameter of the at least one segment of filter material.

14. An aerosol-generating article according to claim 1 wherein the at least one segment of filter material comprises an upstream filter segment and a downstream filter segment downstream of the upstream filter segment, and wherein the liquid delivery element is positioned between the upstream and downstream filter segments.

15. An aerosol-generating article according to claim 1 wherein the frangible tubular element is formed from a polymeric material selected from polystyrene, polyethylene terephthalate, poly(methyl methacrylate) and combinations thereof.

16. An aerosol-generating article according to claim 1, further comprising a plug wrap wrapped about the liquid delivery element and at least one segment of filter material and joining the liquid delivery element to the at least one segment of filter material, wherein the plug wrap contacts the at least one flexible wall of the deformable outer container.

17. An aerosol-generating article according to claim 16, wherein the plug wrap is substantially transparent.

18. An aerosol-generating article according to claim 1, wherein the frangible tubular element does not extend beyond the upstream end or downstream end of the liquid delivery element.

19. A liquid delivery element comprising:

a first end and a second end;

a deformable outer container having an inner surface and at least one flexible wall; and a frangible tubular element mounted within the deformable outer container having an outer surface facing the inner surface of the deformable outer container and defining a longitudinal channel extending continuously through the deformable outer container from the first end to the second end of the liquid delivery element, wherein a cavity is defined by the at least one flexible wall of the deformable outer container and the outer surface of the frangible tubular element, the cavity containing a liquid which surrounds the frangible tubular element and contacts the inner surface of the deformable outer container, the at least one flexible wall seals the liquid within the cavity, wherein the liquid delivery element is configured to release the liquid from the cavity when at least one wall of the frangible tubular element is broken, and wherein the frangible tubular element breaks upon application of a force to the liquid delivery element to deform the deformable outer container.

20. The liquid delivery element of claim 19, wherein the frangible tubular element does not extend beyond the first end or second end of the liquid delivery element.

* * * * *